US008162412B2

(12) United States Patent
Unger

(10) Patent No.: US 8,162,412 B2
(45) Date of Patent: Apr. 24, 2012

(54) DISPENSER

(75) Inventor: Helmut Unger, Bobingen (DE)

(73) Assignee: SCA Hygiene Products AB, Gothenburg (SE)

( * ) Notice: Subject to any disclaimer, the term of this patent is extended or adjusted under 35 U.S.C. 154(b) by 795 days.

(21) Appl. No.: 12/067,460

(22) PCT Filed: Sep. 20, 2005

(86) PCT No.: PCT/SE2005/001376

§ 371 (c)(1),
(2), (4) Date: Jun. 23, 2008

(87) PCT Pub. No.: WO2007/035137

PCT Pub. Date: Mar. 29, 2007

(65) Prior Publication Data

US 2009/0302721 A1 Dec. 10, 2009

(51) Int. Cl.
*B65H 19/00* (2006.01)

(52) U.S. Cl. ..... 312/34.1; 312/325

(58) Field of Classification Search ..... 312/327, 312/328, 248, 34.1, 325; 220/810; 16/366, 16/368, 369, 370, 371
See application file for complete search history.

(56) References Cited

U.S. PATENT DOCUMENTS

| | | | | |
|---|---|---|---|---|
| 1,491,699 | A * | 4/1924 | Hamilton | 312/230 |
| 2,131,576 | A * | 9/1938 | Ziegler | 312/325 |
| 2,355,542 | A * | 8/1944 | Loftin | 16/371 |
| 2,420,010 | A * | 5/1947 | Paxton et al. | 312/325 |
| 2,620,991 | A | 12/1952 | Deffenbaugh | |
| 3,370,318 | A * | 2/1968 | Marchione | 16/288 |
| 3,575,483 | A * | 4/1971 | Church et al. | 312/328 |
| 4,026,434 | A * | 5/1977 | Howard | 220/478 |
| 4,076,351 | A * | 2/1978 | Wyant | 312/247 |
| 4,368,937 | A * | 1/1983 | Palombo et al. | 312/325 |
| 4,371,223 | A * | 2/1983 | Grunert et al. | 312/325 |
| 4,729,616 | A * | 3/1988 | Vogt | 312/325 |
| 4,756,054 | A * | 7/1988 | Mitts et al. | 16/237 |
| 4,838,111 | A * | 6/1989 | Schmidt | 74/526 |
| 4,856,854 | A * | 8/1989 | Nishiyama et al. | 312/34.11 |
| 5,526,973 | A * | 6/1996 | Boone et al. | 225/34 |
| 5,697,576 | A * | 12/1997 | Bloch et al. | 242/596.8 |
| 6,045,204 | A * | 4/2000 | Frazier et al. | 312/247 |
| 6,779,856 | B2 * | 8/2004 | Hornberger et al. | 312/295 |
| 7,635,171 | B2 * | 12/2009 | Rapier, III | 312/321.5 |
| 2005/0264144 | A1 * | 12/2005 | Verbeek et al. | 312/323 |
| 2006/0132007 | A1 * | 6/2006 | Beckley | 312/325 |

FOREIGN PATENT DOCUMENTS

BE 499628 A 3/1951

* cited by examiner

*Primary Examiner* — Darnell Jayne
*Assistant Examiner* — Kimberley S Wright
(74) *Attorney, Agent, or Firm* — Young & Thompson

(57) ABSTRACT

A dispenser (1) for hygienic products, has a main portion (2) attachable to a wall. The dispenser includes a door (7) pivotally mounted to a bottom portion (3) of the main portion (2). The door (7) is operable at a top portion (4) of the main portion (2) and swung out from the main portion (2) in a rotational movement upon opening. The door (7) is pivotally mounted to the main portion (2) via a pair of first and second link arms (10) describing a trapezoid arrangement when the door (7) is closed, and the trapezoid arrangement is arranged to balance the rotational movement of the door (7).

19 Claims, 3 Drawing Sheets

DISPENSER

TECHNICAL FIELD

The invention refers to a dispenser for hygienic products. The dispenser comprises a door pivotally mounted to a bottom portion of a main portion. The door is openable at a top portion of the main portion and is swung out from the main portion in a rotational movement upon opening.

BACKGROUND ART

In the field of dispensers for storing and dispensing hygienic products, one type of dispenser comprises a main portion attached to a wall and a door pivotally mounted to a bottom portion of the main portion via pivoting means. The door is opened at a top portion of the main portion and is swung out from the wall in a rotational movement about the pivoting means. The dispensers are equipped with an opening in the bottom portion from which the hygienic products are accessible. The opening is preferably positioned 1-1.5 meters from the floor for optimal comfort for the user. The dispenser is about 0.5 meters high from the bottom portion to the top portion. The present dispensers have the problem that the door when opened is subject to gravity and therefore starts rotating with a high rotational speed unless handled by the user. Furthermore, the top portion is placed at a high position and the door may therefore for some users be hard to handle to control the rotation.

There is thus a need for a better dispenser where the above stated disadvantages are removed and the loading of hygienic products is simplified.

DISCLOSURE OF INVENTION

The invention refers to a dispenser for storing hygienic products. For example, hand towels or a roll of paper, or the like. In the following description, hand towels will be used when describing the invention. The hand towels are normally folded and stacked on top of each other. The hand towels may also be in the form of single sheet not being folded.

The dispenser comprises a main portion attached to a wall and a door pivotally mounted to a bottom portion of the main portion. The door is opened at a top portion of the main portion and is swung out from the main portion in a rotational movement. The invention is characterised in that the door is attached to the main portion via a pair of first and second link arms. In a preferred embodiment the door is attached via two pairs of first and second link arms.

The first link arms are pivotally mounted to each side of the main portion at first points of attachment and are pivotally mounted to each side of the door via second point of attachment. The second link arms are pivotally mounted to each side of the main portion at third points of attachment and are pivotally mounted to each side of the door via fourth points of attachment.

In order to facilitate the description of the invention only one side of the dispenser is described. In the embodiment comprising two pairs of first and second link arms, the opposite side is of course arranged in a similar manner.

In at least a closed door position, the first and second link arms together with an imaginary line between the first and third points of attachment and an imaginary line between the second and fourth point of attachment, describe a trapezoid.

The first point of attachment is placed above and closer to the door than the third point of attachment. The second point of attachment is placed above and closer to the door than the fourth point of attachment.

The benefits of the invention is that the link arms balances the door such that when opened the door slowly rotates to a stopping position. The stopping position is an intermediate or semi-closed position where the door is open enough for a user to handle the door from a lower position than at the top portion. The lower position refers to a suitable point somewhere between the bottom portion and the top portion. The user may handle the door by grabbing the door by its sides or one of its sides, in a crack between the door and the main portion. The user may then continue to open the door by forcing the door over the stop position to a position where the door hangs essentially up-side down in the link arms.

Another advantage of the invention is that, in the semi-closed position, a user may top up the stack of sanitary towels through the gap between the door and the main portion.

In one embodiment of the invention, an upper part of the door is bent towards the main portion at an angle to a main part of the door, i.e. the rest of the door. The angle is preferably essentially perpendicular since this gives the door a special feature when hanging up-side down, namely a possibility for the user to load hygienic products onto the angled upper part whereafter the door is closed and the stack of hygienic products automatically falls into place in the dispenser. The angle may of course be at another angle than essentially perpendicular, as long as the user experiences the benefit of being able to load the hygienic products according to above.

In one embodiment of the invention, the main portion comprises a back portion attached to the wall and two side portions extending essentially perpendicular from the back portion and from the bottom portion to the top portion. The side portions have a contour that follows the contour of the door such that when the door is closed, the door covers the edge portions of the side portions facing the door. The first and third points of attachment are placed at each side portions.

In one embodiment of the invention, the door comprises attachment means on each side of the door extending essentially perpendicular from the door in the direction towards the main portion when the door is closed. The second and fourth points of attachment are positioned on the first attachment means. The attachment means may be in the form of one piece or in the form of a number of pieces. In the latter case, the first link arm may be attached to one piece and the second link arm to a second piece.

The dispenser is equipped with an opening in the bottom portion from which the hygienic products are accessible.

In one embodiment of the invention, the second link arm is placed closer to the side portion than the first link arm and the first link arm is placed between the second link arm and the first attachment means. This position of the link arms gives the necessary possibility for the fourth point of attachment to pass the first link arm during the movement of the door from opened to closed position and vice versa.

In one embodiment of the invention, a stop member is placed at each or one of the side portions, between the side portion and the second link arm. The stop member blocks the movement of the second link arm in the semi-closed position. In order for the door to be further opened, the user has to force the door open by forcing the second link arm over the stop member. Here forcing the second link arm refers to the situation where the user rotates the door from the semi-closed position to the open position.

In the semi-closed position the rotational force of the door is fairly low why the stop member does not have to be in the form of a large physical block, but merely a frictional element applying frictional force enough to stop the door from continuing its rotation unless forced by a user.

The stop member does not need to be positioned between the side portion and the second link arm, but may be placed at another suitable position giving the desired effect. For example, the stop member may be positioned between the first link arm and the second link arm.

All the above embodiments may be combined because the effect of the link arm system becomes as described above. Furthermore, the link arms are positioned such that they balance the rotational movement of the door by leverage. The balancing gives a rotational acceleration equal to or close to zero from the closed position to the semi-closed position. This means that the rotational speed of the upper portion of the door is essential constant or at most linearly increasing. Furthermore, when the door is rotated from the closed position to the semi-closed position, the link arm system transforms some of the rotational energy into a translational energy forcing the bottom part of the door both in an upward direction and in a horizontal direction. Here upward refers to a counter gravity direction and the horizontal direction refers to a direction perpendicular to the main portion.

In order for the door to swing open according to the above, the vertical line of the centre of gravity of the door must pass outside the second point of attachment, i.e. between the second point of attachment and the door. This is because the door is hanging in the first link arms in pivotal axes in the second points of attachment and starts its rotation about these axes. The door is also supported by the second link arms via pivotal axes in the fourth points of attachment. When the door starts to rotate the second link arms initially hinder movement of the most bottom part of the door and thereby forces the first link arm to rotate outwardly, i.e. towards the door. The rotation of the first link arm causes rotation of the second link arm in the same direction. The rotation of the two link arms gives the translational movement of the door. The translational movement of the door is a consequence of that the second point of attachment moves along the rotational path of the first link arm and the fourth point of attachment moves along the rotational path of the second link arm, where the first link arm and the second link arm has different centres of rotation. The link arms may however have the same length, i.e. describing similar sizes of circles, but at different location. The link arms may also have different length thereby describing circles of different radii.

The position of the first, second, third and fourth points of attachment together with the lengths of the first and second link arms decides the translational movement and thus the possibility to transform the rotational energy from the door. The translational movement thus has to be matched with the centre of gravity of the door in order to balance the rotational movement of the door according to above.

In one embodiment of the invention, the door is locked in its closed position, and the centre of gravity of the door is outside the second point of attachment in the closed position. As a consequence, the door will automatically start to swing open, i.e. rotate outwardly, when the door is unlocked. Preferably the lock is positioned in the top portion, but may also be positioned in any of the side portions or even the bottom portion.

The above description is also valid for a roll bar. IN this case, the dispenser may be equipped with a tear bar in the vicinity of the opening in the bottom portion.

BRIEF DESCRIPTION OF DRAWINGS

The invention will below be described in connection to a number of drawings, where.

EMBODIMENT OF THE INVENTION

Figure 1:
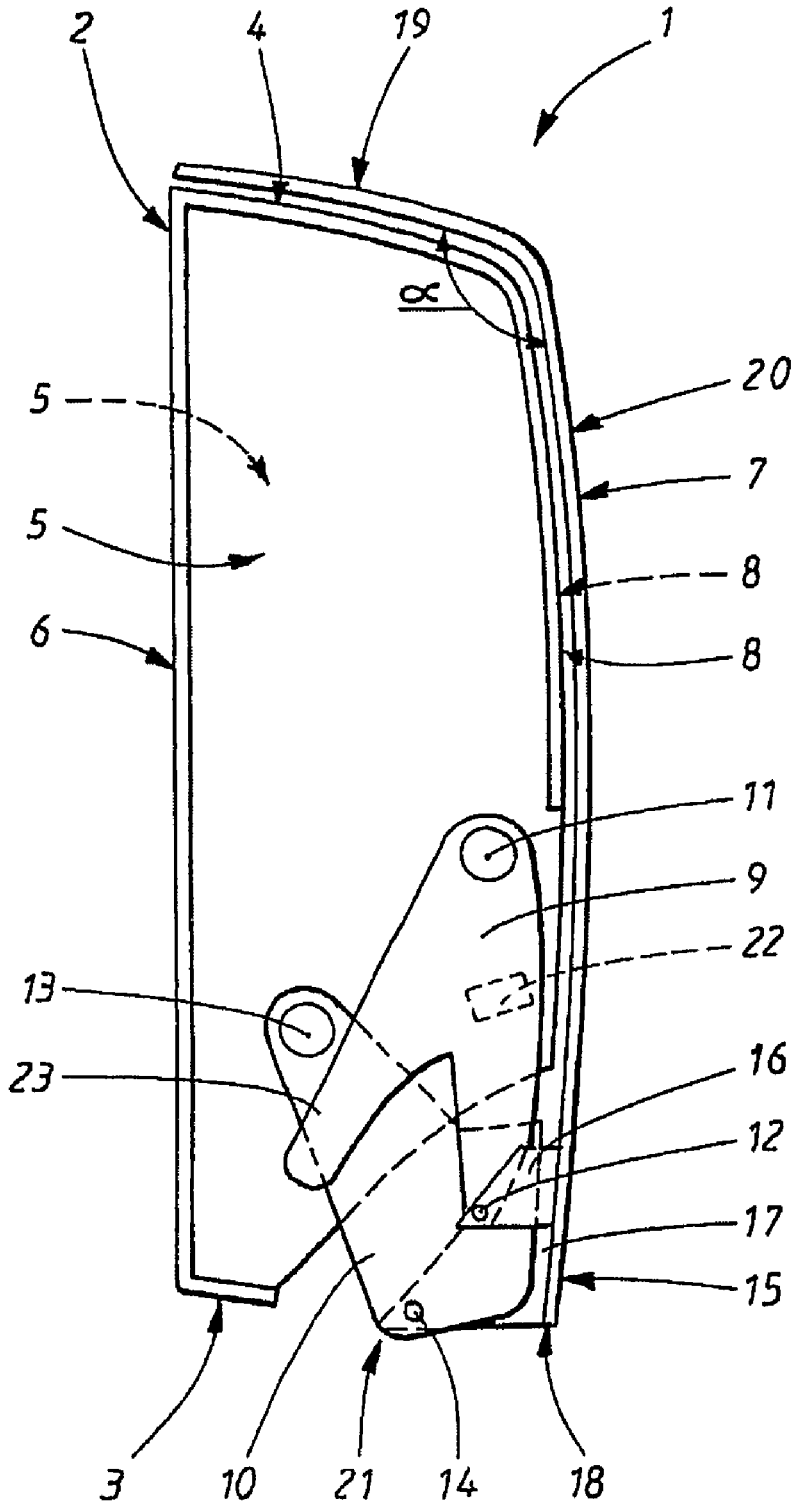
FIG. 1 schematically shows a side view of a dispenser according to the invention in a closed position.

FIG. 1 schematically shows a side view of a dispenser 1 according to the invention in a closed position. The dispenser 1 comprises a main portion 2, a bottom portion 3, a top portion 4, two side portions 5, a back portion and a door 7. The back portion 6 is attachable to a wall (not shown). The door 7 is pivotally mounted to the bottom portion 3 of the main portion 2. The side portions 5 extend essentially perpendicular from the back portion 6 and extend from the bottom portion 3 to the top portion 4. The side portions 5 have a contour that follows the contour of the door 7 such that when the door 7 is closed, the door 7 covers edge portions 8 of the side portions 5 facing the door 7.

The door 7 is opened at the top portion 4 of the main portion 2 and is swung out from the main portion 2 in a rotational movement. The door 7 is attached to the main portion 2 via two pairs of first and second link arms 10. The first link arms 9 are pivotally mounted to the side portions 5 at first points of attachment 11 and are pivotally mounted to each side of the door 7 via second points of attachment 12. The second link arms 10 are pivotally mounted to the side portions 5 at third points of attachment 13 and are pivotally mounted to each side of the door 7 via fourth points of attachment 14. The second and fourth points of attachment 14 are positioned at a bottom part 15 of the door 7.

The door 7 comprises first and second attachment means 17 on each side of the door 7 extending essentially perpendicular from the door 7 and in the direction towards the main portion 2 when the door is closed. The second points of attachment 12 are positioned on the first attachment means 16 and the fourth points of attachment 14 are positioned on the second attachment means 17. The first attachment means 16 are positioned on the door 7 at a distance from a bottom edge of the door 7. The second attachment means 17 are positioned between the bottom edge 18 and the first attachment means 16.

An upper part 19 of the door 7 is bent towards the main portion 2 at an angle $\alpha$ to a main part 20 of the door 7. The angle $\alpha$ is preferably essentially perpendicular since this gives the door 7 a special feature when hanging up-side down, namely a possibility for the user to load hygienic products (not shown) onto the angled upper part 19 whereafter the door 7 is closed and the hygienic products automatically falls into place in the dispenser 1.

The dispenser 1 is equipped with a bottom opening 21 in the bottom portion 3 from which the hygienic products are accessible.

The side portions 5 comprise stop members 22 for reasons described in connection to FIG. 2.

Figure 2:
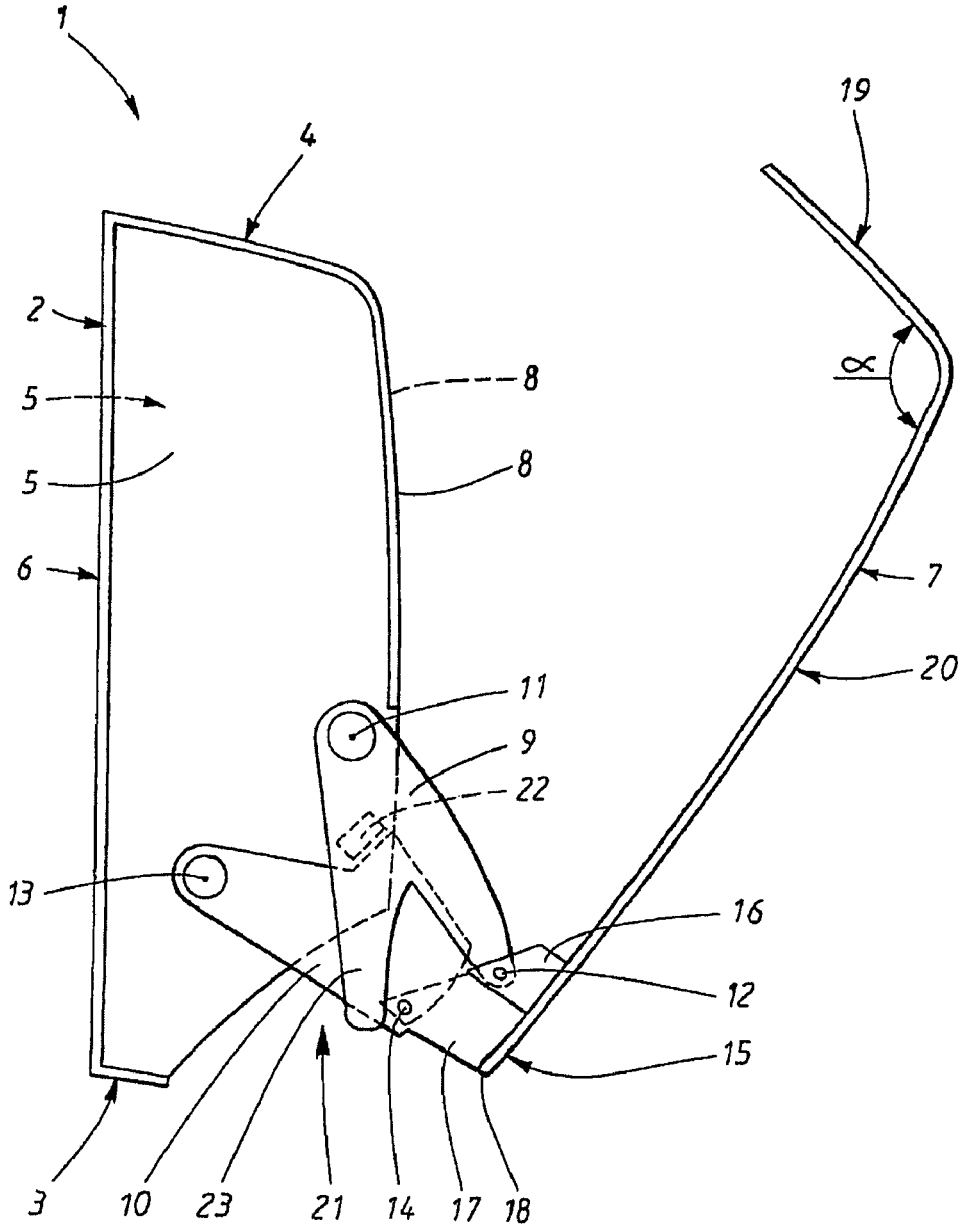
FIG. 2 schematically shows a side view of a dispenser according to the invention in a semi-closed position, and where.

In FIG. 1 the first link arm 9 comprises a reinforcement member 23, reinforcing the second link arm 10 over the stop member 22 in an intermediate, semi-closed position shown in FIG. 2.

FIG. 2 schematically shows a side view of the dispenser 1 according to the invention in a semi-closed position.

The stop members 22 are placed at each of the side portions 5, between the side portion 5 and the second link arm 10. The stop members 22 block the movement of the second link arms 10 in the semi-closed position. In order for the door 7 to be further opened, the user has to force the door 7 open by forcing the second link arm 10 over the stop member 22.

When comparing FIG. 1 and FIG. 2, the upper part of the door 7 has rotated outwardly about the link arm system. Furthermore, the rotation has forced the link arm system 9, 10 to move the bottom part 15 of the door in a translational movement both in the vertical direction and in the horizontal direction. Here translational refers to a linear movement. Hence, the translational movements give the door a diagonal movement during the rotation of the upper part.

Referring now to side portion 5 facing the reader in FIG. 2, the fourth point of attachment 14 is essentially in line with the third point of attachment 13 and the bottom edge 18 of the door 7. This semi-closed position is the limiting position for the translational movement. Continuous rotation of the upper part 19 will, due to the link arm system 9, 10, make the fourth point of attachment 14 to rotate about the first point of attachment 12 in a clockwise direction until the second link arm 10 forces the first point of attachment 12 to start to rotate about the fourth point of attachment 14 in a clockwise direction. Hence, the first link arm 9 and the second link arm 10 rotate in a counter-clockwise manner when the door rotates from the closed position to the semi-closed position. After the semi closed position, the first link arm 9 is not moving until the fourth point of attachment 14 has passed the first point of attachment 12 in the vertical direction. At this position the second link arm 10 and the rotation of the upper part 19 of the door 7 causes the first link arm 9 to change direction of rotation. In the case now described into a clockwise rotation about the first point of attachment 11. The same will of course happen at the opposite side portion, but in mirror-type of way.

Figure 3:
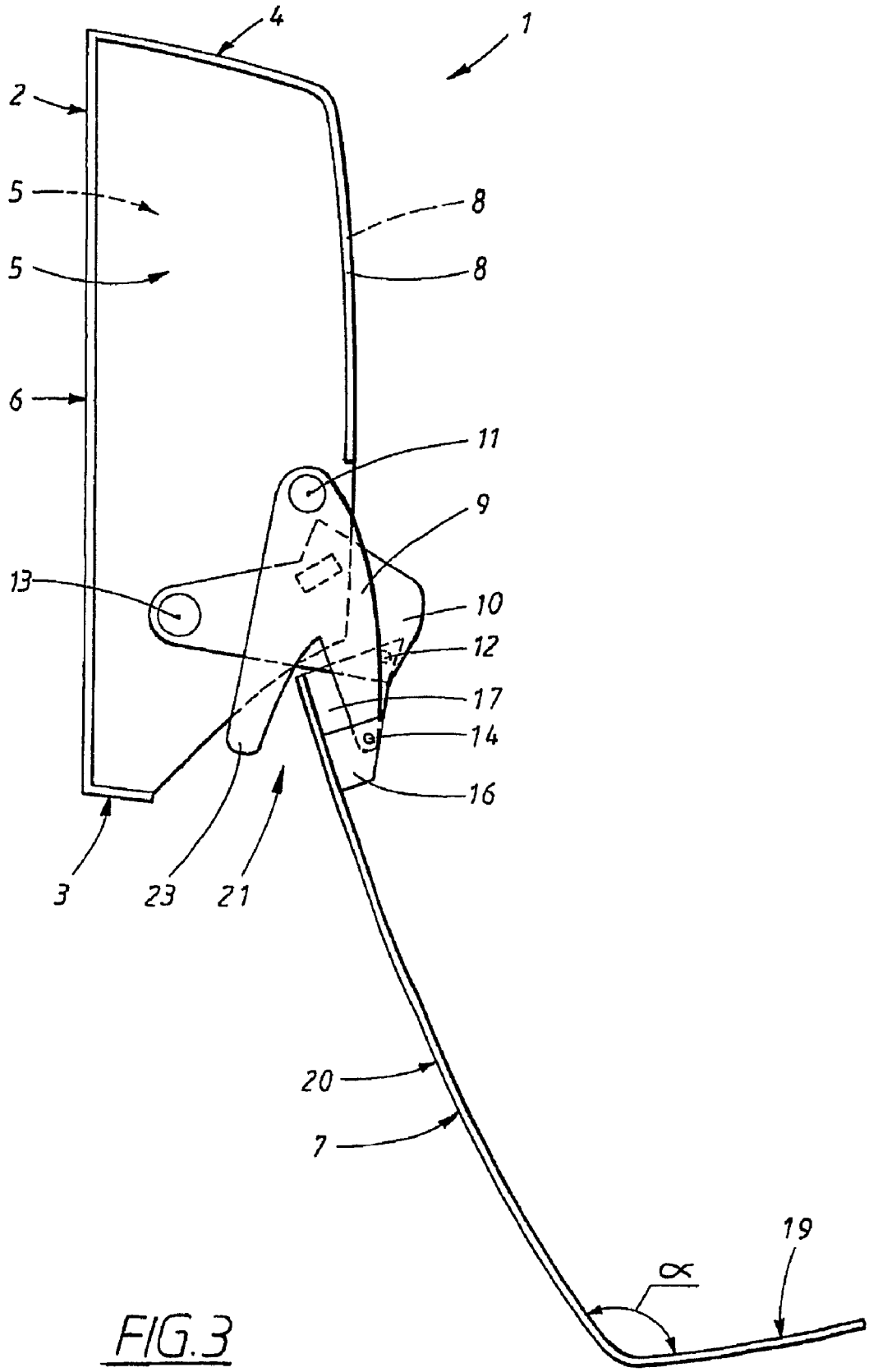
FIG. 3 schematically shows a side view of a dispenser according to the invention in an open position.

FIG. 3 schematically shows a side view of the dispenser 1 according to the invention in an open position.

The second link arm 10 is placed closer to the side portion 5 than the first link arm 9 and the first link arm 9 is placed between the second link arm 10 and the first attachment means 16. This position of the link arms 9, 19 gives the necessary possibility for the fourth point of attachment 14 to pass the first link arm 9 during the movement of the door 7 from open to close and vice versa.

In the open position the fourth points of attachment 14 have passed the second points of attachment 12 in a vertical direction. This is a requirement for rotating the door 7 from the closed position in FIG. 1 to the open position in FIG. 3.

The invention claimed is:

1. A dispenser for hygienic paper products, comprising:

a main portion, a bottom portion, a top portion, two side portions, a back portion and a door, where the back portion is attachable to a wall, the side portions extending essentially perpendicular from the back portion and extend from the bottom portion to the top portion, at least one of said side portions having a stop member;

the door is pivotally mounted to the bottom portion of the main portion, and being openable at the top portion of the main portion and swung out from the main portion in a rotational movement upon opening so that an upper part of the door swings away from the top portion, wherein the door is pivotally mounted to the main portion via at least a pair of first and second link arms;

the first link arm having a reinforcement member, the first link arm being pivotally mounted to one of the side portions at a first point of attachment separate from the reinforcement member and pivotally mounted to a side of the door via a second point of attachment near a bottom part of the door;

the second link arm being pivotally mounted to the side portion at a third point of attachment and is pivotally mounted to the side of the door via a fourth point of attachment near the bottom part of the door;

wherein, in a closed door position, the first and second link arms together with an imaginary line between the first and third points of attachment and an imaginary line between the second and fourth point of attachment describe a trapezoid arrangement arranged to balance the rotational movement of the door upon opening due to the first link arm being arranged to give the second point of attachment a movement along a rotational path of the first link arm about the first point of attachment;

the second link arm being arranged to give the fourth point of attachment a movement along a rotational path of the second link arm about the third point of attachment, the first link arm and the second link arm having different centres of rotation; and the reinforcing member is configured to reinforce the second link arm over the stop member in an intermediate semi-closed position.

2. The dispenser according to claim 1, wherein the door is pivotally mounted to the main portion via at least a pair of first and second link arms.

3. The dispenser according to claim 2, wherein the first link arms are pivotally mounted to each side of the main portion at the first points of attachment and are pivotally mounted to each side of the door via second points of attachment, and the second link arms are pivotally mounted to each side of the main portion at the third points of attachment and are pivotally mounted to each side of the door via the fourth points of attachment.

4. The dispenser according to claim 3, wherein the first point of attachment is placed above and closer to the door than the third point of attachment and where the fourth point of attachment is placed below and closer to the main portion than the second point of attachment.

5. The dispenser according to claim 1, wherein the side portions have a contour that follows a contour of the door such that when the door is closed, the door covers edge portions of the side portions facing the door.

6. The dispenser according to claim 1, wherein the upper part of the door is bent towards the main portion at an angle to a main part of the door.

7. The dispenser according to claim 1, wherein first and second link arms are arranged such that the rotational movement of the door is transformed also into a translational movement of the bottom part of the door in both a horizontal direction and in a vertical direction.

8. The dispenser according to claim 7, wherein the translational movement is a consequence of that the first link arm being arranged to give the second point of attachment a movement along the rotational path of the first link arm, and where the second link arm is arranged to give the fourth point of attachment a movement along the rotational path of the second link arm; and the first link arm and the second link arm having different centres of rotation.

9. The dispenser according to claim 2 wherein the side portions have a contour that follows a contour of the door such that when the door is closed, the door covers edge portions of the side portions facing the door.

10. The dispenser according to claim 3, wherein the side portions have a contour that follows a contour of the door such that when the door is closed, the door covers edge portions of the side portions facing the door.

11. The dispenser according to claim 4, wherein the side portions have a contour that follows a contour of the door such that when the door is closed, the door covers edge portions of the side portions facing the door.

12. The dispenser according to claim 2, wherein the upper part of the door is bent towards the main portion at an angle to a main part of the door.

13. The dispenser according to claim 3, wherein the upper part of the door is bent towards the main portion at an angle to a main part of the door.

14. The dispenser according to claim 4, wherein the upper part of the door is bent towards the main portion at an angle to a main part of the door.

15. The dispenser according to claim 2, wherein first and second link arms are arranged such that the rotational movement of the door is transformed also into a translational movement of the bottom part of the door in both a horizontal direction and in a vertical direction.

16. The dispenser according to claim 3, wherein first and second link arms are arranged such that the rotational movement of the door is transformed also into a translational movement of the bottom part of the door in both a horizontal direction and in a vertical direction.

17. The dispenser according to claim 4, wherein first and second link arms are arranged such that the rotational movement of the door is transformed also into a translational movement of the bottom part of the door in both a horizontal direction and in a vertical direction.

18. The dispenser according to claim 5, wherein first and second link arms are arranged such that the rotational movement of the door is transformed also into a translational movement of the bottom part of the door in both a horizontal direction and in a vertical direction.

19. A dispenser for hygienic paper products, comprising:

a main portion;

a bottom portion;

a top portion;

a back portion;

two side portions, at least one of said side portions having a stop member the side portions extending essentially perpendicular from the back portion and extend from the bottom portion to the top portion, at least one of said side portions having a stop member;

a back portion configured to be attachable to a wall;

a door pivotally mounted to the bottom portion and being openable at the top portion and swung out from the main portion in a rotational movement upon opening so that an upper part of the door swings away from the top portion, wherein the door is pivotally mounted to the main portion via at least a pair of first and second link arms;

the first link arm having a reinforcement member, the first link arm being pivotally mounted to one of the side portions at a first point of attachment separate from the reinforcement member and pivotally mounted to a side of the door via a second point of attachment near a bottom part of the door; and the second link arm being pivotally mounted to the side portion at a third point of attachment and is pivotally mounted to the side of the door via a fourth point of attachment near the bottom part of the door;

wherein in a closed door position, the first and second link arms together balance the rotational movement of the door upon opening due to the first link arm being arranged to give the second point of attachment a movement along a rotational path of the first link arm about the first point of attachment, the first link arm and the second link arm having different centres of rotation, and the reinforcing member is configured to reinforce the second link arm over the stop member in an intermediate semi-closed position.

* * * * *